United States Patent [19]

Stumpp et al.

[11] 4,294,211

[45] Oct. 13, 1981

[54] METHOD AND APPARATUS FOR CORRECTING THE FUEL QUANTITY IN AN INTERNAL COMBUSTION ENGINE

[75] Inventors: Gerhard Stumpp, Stuttgart; Wolf Wessel, Oberriexingen, both of Fed. Rep. of Germany

[73] Assignee: Robert Bosch GmbH, Stuttgart, Fed. Rep. of Germany

[21] Appl. No.: 14,197

[22] Filed: Feb. 22, 1979

[30] Foreign Application Priority Data

Feb. 24, 1978 [DE] Fed. Rep. of Germany ..... 2807924

[51] Int. Cl.[3] ..... F02M 59/20

[52] U.S. Cl. ..... 123/379; 123/357; 123/340

[58] Field of Search ..... 123/140 EG, 140 R, 32 EA, 123/379, 357, 340, 455

[56] References Cited

U.S. PATENT DOCUMENTS 4,132,195 1/1979 Bianchi et al. ..... 123/32 EA 4,174,694 11/1979 Wessel et al. ..... 123/140 MC

*Primary Examiner*—Harry N. Haroian

*Attorney, Agent, or Firm*—Edwin E. Greigg

[57] ABSTRACT

A method and apparatus for correcting the fuel quantity delivered by a fuel injection apparatus to an internal combustion engine, in particular for correcting the full-load fuel quantity per stroke, whereby a control value corresponding to the fuel injection quantity per time unit is formed and is converted into a control value corresponding to the fuel injection quantity by means of division of a value dependent on the rpm, the injection quantity per stroke being corrected by means of an adjustment of the fuel quantity control device of the fuel injection apparatus in accordance with the deviation of this converted control value from a set-point value.

22 Claims, 4 Drawing Figures

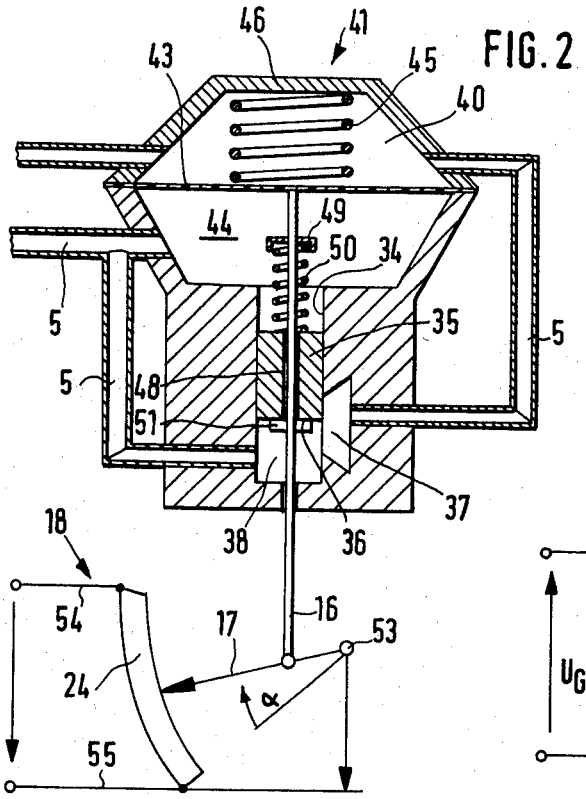
FIG. 2
FIG. 3
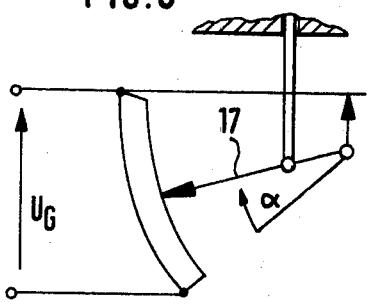
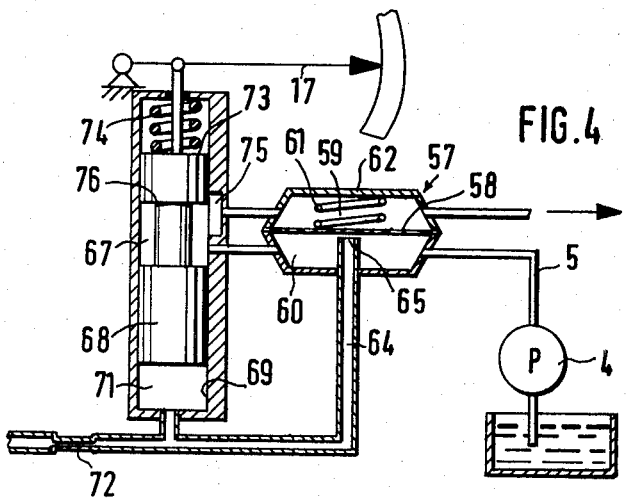
FIG. 4

METHOD AND APPARATUS FOR CORRECTING THE FUEL QUANTITY IN AN INTERNAL COMBUSTION ENGINE

BACKGROUND OF THE INVENTION

The invention relates to a method and apparatus for correctly proportioning the fuel quantity in an internal combustion engine. Well-known apparatuses of this type utilize a mechanically functioning rpm governor, which regulates downward the fuel injection quantity precontrolled arbitrarily at the fuel quantity control device when, for example, a desired rpm value is attained.

An apparatus is also known in which the fuel quantity delivered to a fuel injection pump is compared with the fuel quantity which must be delivered in accordance with the metered induction air quantity. This is accomplished by means of a differential pressure valve, which monitors the pressure drop at a fuel flow-through quantity control device actuated by an air flow rate meter and, when there is a deviation, actuates a throttle valve in the induction tube. In this way, the fresh-air induction cross-section in the induction tube and the cross-section of an exhaust gas return line are varied in a complementary manner. Upon attaining the open position of the throttle valve, a setting apparatus can be controlled, by means of which the quantity control device of the fuel injection apparatus is adjustable in the direction of a reduced fuel quantity, in order thereby to limit the full-load injection quantity. This apparatus has the disadvantage that, on the one hand, a very expensive air flow rate meter is necessary and, on the other hand, only the full-load state is detectable as a set-point value. Furthermore, the described apparatus can not be provided without the exhaust gas return apparatus.

OBJECT AND SUMMARY OF THE INVENTION

The arrangement in accordance with the invention has the advantage over the prior art in that a correction apparatus can be provided which can be associated with any desired fuel injection apparatus or fuel injection pump, which is equipped, for example, with a mechanical rpm governor. Thus the possibility is presented for processing various operational parameters at a desired value, the size of which can also vary during operation of the engine, for instance, during the warm-up phase. Thus, in an advantageous manner, the actual fuel quantity delivered to the fuel injection pump is precisely detected with such influences as engine speed, the state of maintenance of the injection nozzles and the fuel temperature being unable to alter the metering product. By means of the correction value provided in accordance with the invention, the fuel quantity injected per stroke can be very precisely influenced, for example, through a regulator rod which is conventional in series injection pumps. Thus, one obtains a very precise and rapid regulator product.

By means of the novel arrangement of the invention, further other embodiments and constructions of the method according to the invention as well as of an apparatus for carrying out the method are possible. It is particularly advantageous that, in the invention, a metering apparatus is provided as the transducer for the fuel flow-through quantity in the fuel supply line which consists of a throttle device disposed in the fuel supply line which is adjustable for correction purposes in accordance with the deviation of the pressure drop on its free flow-through cross-section from a value determined at a differential pressure valve and whose position of the throttle device as the first control value is a standard for the fuel quantity flowing to the fuel injection apparatus per time unit. In this manner, one obtains a very favorable linear association of the control value with the flow-through quantity. Furthermore, the metering apparatus, is easily obtained and thereby utilizes the fuel supply pressure as the setting force in order to generate the first control value by mechanical means.

The invention will be better understood as well as further objects and advantages thereof become more apparent from the ensuing detailed description of a preferred embodiment taken in conjunction with the drawings.

BRIEF DESCRIPTION OF THE DRAWINGS

FIG. 2 is a sectional view of the metering apparatus constructed in accordance with the invention;

FIG. 3 is a view of a different embodiment of a portion of the metering apparatus of FIG. 2; and FIG. 4 is another embodiment of the metering apparatus of the invention.

DESCRIPTION OF THE PREFERRED EMBODIMENT

Figure 1:
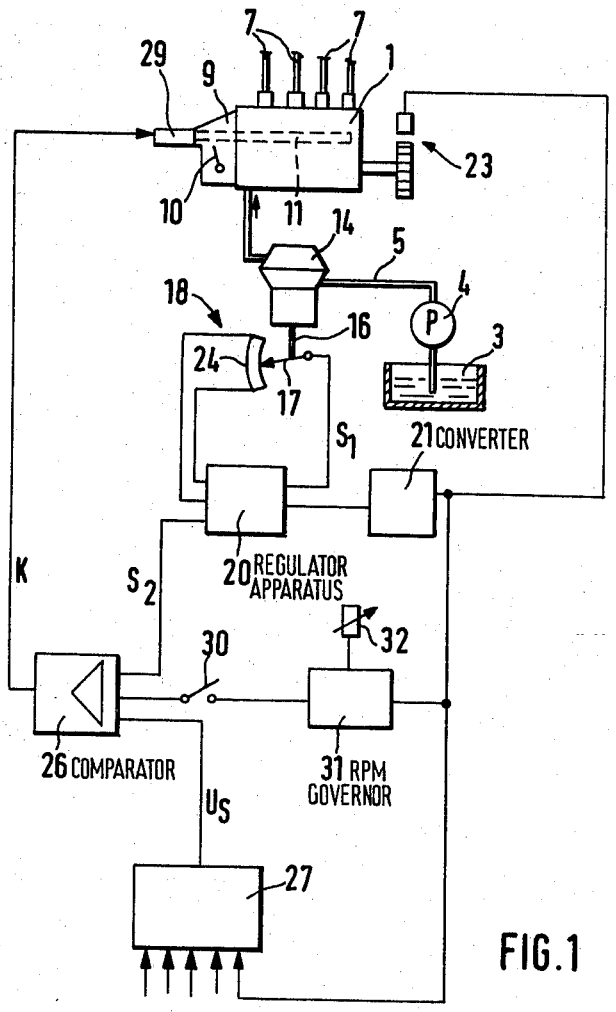
FIG. 1 is a diagrammatic illustration of one embodiment of the invention.

Referring now to FIG. 1, a fuel injection apparatus is provided in the form of a series injection pump 1, which supplies an internal combustion engine (not further shown) with fuel. In this conventional manner, the injection pump is supplied with fuel from a fuel supply container 3 and a pre-supply pump 4 delivers the fuel to the injection pump 1 through a fuel supply line 5. The injection pump 1 thereby operates without scavenging from the fuel supply container 3, so that the fuel quantity delivered through the fuel supply line 5 is exactly equal to the total injection quantity delivered per time unit to the individual injection valves through injection lines 7.

The injection pump 1 in this case is driven in synchronism with the speed of the internal combustion engine and has a governor 9 by which, independently of the position of an arbitrarily actuatable adjustment lever 10, a regulator rod 11 of the injection pump is likewise acutatable in order to maintain the desired fuel injection quantities per stroke. Such governors, which are generally mechanical, serve, for example, to regulate the internal combustion engine downward when the maximum rpm is attained.

A metering apparatus 14 is built into the fuel supply line 5 for metering the fuel quantity flowing per unit of time to the injection pump 1. This metering apparatus is shown in detail in FIG. 2, and its structure and mode of operation will be discussed later herein. If the fuel injection pump 1 is driven with scavenging, then the scavenging quantity is immediately delivered back to the fuel supply line at the entrance into the injection pump. In order to accomplish cooling, a fuel cooler can be provided in such a scavenging line. In this case, the metering apparatus 14 is naturally provided upstream of the discharge point of this scavenging line.

The metering apparatus 14 has an actuation rod 16, whose position as the first control value corresponds to the fuel quantity flowing to the injection pump 1. The actuation rod 16 is connected with the slider 17 of a potentiometer 18, whose pickup voltage value is delivered to a regulator apparatus 20. The regulator apparatus 20 further receives a voltage dependent on the rpm through a converter 21. The converter 21 receives pulses of rpm-dependent frequency from an rpm transducer 23 of known construction. The rpm transducer 23 thereby detects either the rpm of the injection pump or an rpm value proportional thereto of the internal combustion engine.

The resistance path 24 of the potentiometer 18 is supplied with voltage from the output of the regulator apparatus 20 and this voltage is further fed as the second control value S2 to the input of a first comparator apparatus 26. The other input of the comparator apparatus communicates with a set-point transducer 27, which detects one or more operational parameters of the internal combustion engine. Such parameters may be, for example, the rpm, the charge pressure, the fuel temperature, the air temperature or the exhaust gas temperature. The output of the first comparator apparatus 26 supplies a correction value K, which corresponds to the deviation of the second control value S2 from the desired value, to the final control element 29. The final control element 29 communicates with the governor 9, that is, with the regulator rod 11 and causes a corrective adjustment of the regulator rod 11 in accordance with the correction value K.

In substitution therefor, or as a second, lower, desired value as well, the output of an rpm governor 31 can be connected, as is shown in FIG. 1, through a switch 30 with the other input of the first comparator apparatus 26. The rpm regulator 20 thus receives the rpm signal of the rpm transducer 23, and compares this with a value set at the rpm desired-value transducer 32. In accordance with the deviation, a higher or lower value is formed which is compared in the first comparator apparatus 26 with the second control signal and is converted into a corresponding correction value.

In FIG. 2, the metering apparatus 14 is shown in greater detail. The metering apparatus 14 comprises a throttle device in the form of a piston 35 displaceable within a cylinder bore 34, the control edge 36 of which piston 35, formed by one of the front faces, controls a slot-shaped, flow-through cross-section 37 in the wall of the cylinder bore 34. The piston 35 thereby encloses a blind chamber 38 of the cylinder bore 34 with the front face 36. The fuel supply line 5 discharges into the blind chamber 38, and then leaves this chamber again through the slot-shaped, flow-through cross-section 37 disposed in the longitudinal direction of the cylinder bore 34. Thereafter the fuel supply line 5 leads into a second pressure chamber 40 of a differential pressure valve 41 and from there travels to the entry side of the fuel injection pump. The second pressure chamber 40 is separated by a diaphragm 43 from a first pressure chamber 44 of the differential pressure valve 41. This first pressure chamber 44 communicates with the fuel supply line 5 upstream of the flow-through, cross-section 37 as well as with the cylinder bore 34 on the other side of the piston 35.

In the second pressure chamber 40, a compression spring 45 is stretched between the diaphragm 43 and the housing 46 of the differential pressure valve 41. On the other side of the diaphragm 43, the actuation rod 16 is connected with the diaphragm 43 and extends coaxially of the cylinder bore 34 through an axial bore 48 within the piston 35 as well as through a tight passage through the closed end of the cylinder bore 34 to the slider 17 of the potentiometer 18. The actuation rod 16 is movably connected with the slider 17.

The piston 35 is seated loosely on the actuation rod 16 and by means of a compression spring 50 supported at one end on a first stop 49 on the actuation rod 16, is pressed onto a second stop 51 and thus fixed.

OPERATION

The metering apparatus operates in the following manner:

The fuel supplied under substantially constant pressure by the pressure-controlled fuel supply pump 4 through the fuel supply line 5 flows into the first pressure chamber 44 and into the blind chamber 38. The piston 35 is to this extent pressure-balanced. In accordance with the open cross-section at the flow-through, cross-section 37, a pressure drop of greater or lesser extent appears, so that the fuel flows toward the second pressure chamber under reduced pressure. This pressure acts on the diaphragm 43, augmented by the force of the compression spring 45 which determines the differential pressure. If, as a result of excess fuel supply by the fuel injection pump, the pressure in the second pressure chamber 40 drops, then this leads to a control movement of the diaphragm 43 upwards, as long as the pressure in the second pressure chamber 40 again rises because of increased fuel supply as a result of the piston 35 which is also moved upwards and of the thus-enlarged, flow-through cross-section 37. Thus, a balance of forces prevails at the diaphragm.

As a result of the design of the differential pressure valve 41, the differential pressure determined thereby at the flow-through cross-section 37 is kept constant in this manner. The piston 35 then assumes a position at the apportionment cross-section 37 which corresponds linearly to the particular quantity of fuel taken at that time from the injection pump 1. This position also corresponds to the position of the actuation rod 16, with which the piston 35 is coupled through the spring 50. The actuation rod 16 which is movably connected with the slider 17 in an isolated manner indicates, by its position, the injection quantity per unit of time at that moment, as the first control value.

This value for displacement is now converted to an electrical value, whereby the potentiometer 18 serves as the displacement-voltage converter. The potentiometer, in the illustrated embodiment, is a rotary potentiometer, whereby the slider 17 is pivotable about the fixed shaft 53, from whence the pickup value is also picked up. The slider 17 itself is guided over the resistance path 24, which is supplied with voltage by the regulator apparatus 20 via terminals 54 and 55. The rotary angle $\alpha$ of the slider 17 corresponds to the adjustment path of the actuation rod 16 or the open slot length of the flow-through cross-section 37.

In the embodiment according to FIG. 2, the smallest voltage value picked up from the resistance path 24 at the terminal 53 also corresponds to the smallest flow-through cross-section 37. When the rotary angle increases, this voltage value corresponds to the fuel flow-through quantity per time unit in accordance with the formula:

$$\alpha = K_1 \cdot \dot{q}$$

At the slider 17, then the voltage, according to the formula:

$$U_\alpha = \alpha \cdot U_G$$

is picked up. In the regulator apparatus 20, this picked-up voltage value is compared in a comparator apparatus with a voltage which is proportional to the rpm according to the formula:

$$U = k_2 \cdot n$$

This voltage is generated in the converter 21 from the rpm signals of the rpm transducer 23 in a known manner.

In accordance with the deviation of the voltage picked up at the slider 17 from this rpm-proportional voltage, the total voltage $U_G$ supplied to the resistance path 24 is varied until such time as the voltage picked up at the slider 17 is identical to the rpm-proportional voltage. If now the factors $k_1$ and $k_2$ are replaced by the constant factor K, the regulated voltage present at the resistance path 24 is in accordance with the formula:

$$U_G = K \cdot n / \dot{q},$$

and thus is a value which corresponds to the fuel injection quantity per injection procedure.

This voltage is now supplied to the first comparator apparatus 26 and is there compared with a desired value. If $U_G$ is smaller than the desired value voltage $U_S$, this then means that too much fuel in the fuel injection quantity is being injected. The correction signal formed in the first comparator apparatus 26 from this deviation is delivered to the final control element 29 and, by this means, the quantity adjustment device of the injection apparatus is adjusted until the desired fuel injection quantity is attained.

Naturally, in place of the series injection pump shown, any desired injection pump can be used. The final control element 29 then must be adapted to the particular fuel quantity control device provided in such a pump. With this apparatus, a very precise regulation of the full-load fuel injection quantity, which may be influenced by various engine operating characteristics, is possible.

In order to maintain a control voltage, which is proportional to the injection quantity per injection procedure, a potentiometer in accordance with FIG. 3 can be used, which exhibits a hyperbolic characteristic curve. In this case, the resistance path 24 is switched in such a manner that, the greatest voltage or the entire voltage $U_G$ can be picked up at the slider 17 at the smallest adjustment angle $\alpha$ corresponding to the smallest fuel supply quantity. At an increasing $\alpha$, the pickup voltage then decreases. As in the preceding example as well, the total voltage $U_G$ present on the resistance path 24 is varied. The voltage picked up at the slider 17 in this case is compared with a voltage which is proportional to the engine revolution time in accordance with the formula:

$$U = k3 \cdot 1/n$$

The formation of this voltage proportional to the revolution time may take place, for example, by means of electronic integration through the revolutions of the camshaft of the internal combustion engine or the drive shaft of the injection pump. Since the total voltage $U_G$ is subsequently regulated until such time as the pickup voltage at the slider 17 is identical to the voltage proportional to the revolution time, one obtains by the formula:

$$U_G = K \cdot \dot{q} / n$$

the total voltage. With this second control value $S_2$, which is conveyed to the first comparator apparatus 26, the comparison with the desired value voltage can be accomplished in a simple manner and, for example, the desired value voltage can be formed in proportional dependence on, for example, the rpm.

In a fuel injection pump having a mechanical governor, which is designed substantially so as to promote good vehicle operation, a constant rpm can additionally be regulated by means of the desired value which can be fed additionally or alternatively through the switch 30. This is of great utility, for instance, in agricultural tractors, in which, for particular types of operation, constant rpm at as great a load as possible are required. In this case, the adjustment lever 10 is brought into the full-load position and the switch 30 is closed. Then the injection quantity is regulated, below the full-load curve predetermined by the mechanical or other type of governor, in such a manner that a constant rpm level is maintained independently of the engine loading.

FIG. 4 shows a different form of the path transducer from that of FIGS. 1–3. Here, a differential pressure valve 57 is provided, in which a first pressure chamber 59 is separated by a diaphragm 58 from a second pressure chamber 60. In the first pressure chamber 59, there is a compression spring 61 which is supported between the housing 62 and the diaphragm 58. A relief line 64 leads into the second pressure chamber 60 directly perpendicular to the diaphragm 58. The discharge aperture 65 of the relief line 64 can thus be throttled or closed by deflection of the diaphragm 58.

The fuel supply line 5 discharges into the second pressure chamber 60 and leads out from there into an annular chamber 67 in a cylinder, which is formed by an annular groove in a piston 68 and cylindrical bore 69 in which this piston 68 is guided. The front face of the piston 68 encloses within the cylindrical bore 69, a work chamber 71, which communicates with the relief line 64 upstream of a throttle 72 disposed in the relief line 64. The opposite front face 73 of the piston 68 is acted upon by a compression spring 74 supported within the cylindrical bore 69. Furthermore, the front face 73, when an insulation part is interposed, is connected in an articulated manner with the slider 17 of a potentiometer formed similarly to that of the embodiments of FIGS. 1–3.

While the fuel supply line 5 leading to the annular chamber 67 discharges freely into the annular chamber, the flow exit, which is in the form of a longitudinal slit 75, is controlled by the first limitation edge 76 of the annular groove forming the annular chamber 67. From the longitudinal slit 75, the fuel supply line 5 leads into the first pressure chamber 59 of the differential pressure valve 57 and from there to the fuel injection pump 1.

The apparatus operates in the following manner:

The pressure drop appearing at the apportionment cross-section of the slit 75 is determined by the compression spring 61 in the first pressure chamber 59 of the differential pressure valve 57. If more fuel is drawn from the fuel injection pump 1 than can flow over the slit 75 at this pressure drop, then the pressure decreases in the first pressure chamber 59. The diaphragm 58 moves accordingly away from the exit apeture 65, so that increased fuel can flow out through the relief line 64. Then, a higher pressure builds up at the throttle 72 and becomes effective in the work chamber 71 to displace the piston 68 against the force of the compression spring 74 until the piston 68 is in a balanced position.

Accordingly, the slider 17 of the potentiometer is also adjusted and the apportionment cross-section at the slit 75 is enlarged. As a result of the increased fuel quantity flowing toward the first pressure chamber 59, the differential pressure valve 57 is again brought into the balanced position. In the embodiment of FIG. 4 as well, the pressure drop at the apportionment cross-section at slit 75 is constantly regulated, so that the position of the piston 68 is in a linear relationship with the quantity of fuel injected at a time from the fuel injection quantity.

This apparatus has the advantage that, since the full working pressure of the fuel supply pump 4 is directly available for the adjustment of the piston 68, the fuel quantity changes are detected virtually without inertia and thus a rapid regulation is possible which is subject to a small dead time. Instead of the potentiometer 18 described here, other displacement-voltage converters may naturally be employed. In particular, an inductive transducer, for example, or a short circuit annular transducer may be employed. If a signal is obtained by means of such a transducer, whose voltage is directly proportional to the flow-through quantity per unit of time, then division with a voltage proportional to the rpm can take place by electronic means, in order to obtain a control signal which is proportional to the fuel injection quantity per injection procedure or per supply stroke of the injection pump. The division of this electrical signal may be carried out, for example, by means of integration over the period of one revolution. It is of particular advantage here, as in the embodiments described previously as well, that as the first control value, a value is generated which is linear to the measured value. Thus, desired conversions and adaptations may be performed with a simplified embodiment.

The foregoing relates to preferred embodiments of the invention, it being understood that other embodiments and variants thereof are possible within the spirit and scope of the invention, the latter being defined by the appended claims.

What is claimed and desired to be secured by Letters Patent of the United States is:

1. A method for the correction of a fuel quantity apportioned to an internal combustion engine in accordance with the deviation of the same from a desired value having a fuel injection apparatus which has a control device having an apparatus for the arbitrary and/or regulatable adjustment of the fuel injection quantity per injection step characterized by the steps of measuring the fuel quantity delivered per unit of time to the fuel injection apparatus as a first control value, converting said first control value with consideration of the rpm into a second control value in accordance with the quantity of fuel injected per injection step, comparing said second control value with a desired value which is variable in accordance with at least one operational parameter, and generating a correction value in accordance with the deviation of said second control value from the desired value for the purpose of adjusting the control device of the injection apparatus.

2. A method in accordance with claim 1, including the step of providing a measuring apparatus for generating said first control value which varies in linear relationship with the fuel injection quantity per unit of time.

3. A method in accordance with claim 2, wherein said second control value is generated during said converting step by a division of a value proportional to said first control value by a value proportional to the rpm of the internal combustion engine.

4. A method in accordance with claim 2, wherein said second control value is generated during said converting step by a division of a value proportional to the inverse value of said first control value by a value proportional to the period of revolution of the camshaft of the internal combustion engine.

5. An apparatus for the correction of a fuel quantity apportioned to an internal combustion engine in accordance with the deviation of the same from a desired value having a fuel injection apparatus which is supplied with fuel via a fuel supply line and which has a fuel control regulator device, the position of which can be corrected by a control apparatus in accordance with the deviation of the fuel quantity delivered via the fuel supply line from a desired value comprising, in combination, a metering apparatus disposed in the fuel supply line for providing a first control value proportional to the fuel injection quantity per unit of time, a regulator apparatus which detects the engine rpm for converting said first control value into a second control value which is a variable in accordance with the fuel injection quantity per injection step and a first comparator apparatus for comparing said second control value with a desired value and for providing a correction value corresponding to the deviation can be generated whereby the position of the fuel control regulator device can be corrected by means of said correction value.

6. An apparatus in accordance with claim 5, whereby said metering apparatus operates mechanically and is adapted to furnish a displacement value as said first control value.

7. An apparatus in accordance with claim 6, including a displacement-voltage converter for converting said first control value into an electrical control value.

8. An apparatus in accordance with claim 7, wherein said regulator apparatus divides said electrical control value by a value dependent on the rpm.

9. An apparatus in accordance with claim 8, wherein said displacement-voltage converter comprises a potentiometer.

10. An apparatus in accordance with claim 9, wherein said regulator apparatus is switched in series with said potentiometer, said potentiometer having a pickup, the voltage picked up at said potentiometer pickup being compared in said regulator apparatus with a voltage proportional to the rpm and corrected accordingly when there is deviation from said rpm-proportional voltage by varying the total voltage present at said potentiometer and including means for delivering said total voltage as said second control value to said first comparator apparatus.

11. An apparatus in accordance with claim 9, wherein said potentiometer has a hyperbolic characteristic curve and the highest voltage at said potentiometer can be derived at said pickup at the smallest value of said first control value.

12. An apparatus in accordance with claim 11, wherein said regulator apparatus is switched in series with said potentiometer having a pickup, the voltage detectable at said potentiometer pickup in said regulator apparatus being compared with a voltage proportional to the period of revolution of the camshaft of the internal combustion engine, and in accordance with the deviation thereof, the total voltage present at said potentiometer being correctable accordingly and including means for delivering said varied total voltage as a record control value to said first comparator apparatus.

13. An apparatus in accordance with claim 5, wherein a desired value can be fed to said first comparator apparatus, whose value as the rpm correction value corresponds to the deviation of the actual rpm from a set rpm.

14. An apparatus in accordance with claim 13, including means for inserting said rpm correction value as a supplemental desired value in the circuit additionally to the desired correction value to thereby limit the full-load fuel injection quantity.

15. An apparatus in accordance with claim 7, wherein said metering apparatus includes a differential pressure valve, a throttle device having a flow-through cross section disposed in the fuel line and whose position determines said second control value, said throttle device being correctingly adjustable in accordance with the deviation of the pressure drop at its flow-through cross section from a value determined at a differential pressure valve and whose position as the second control value, is a standard for the fuel quantity flowing through the fuel line per unit of time.

16. An apparatus in accordance with claim 15, including means for connecting said throttle device to said displacement-voltage converter.

17. An apparatus in accordance with claim 15, wherein said differential pressure valve includes a first pressure chamber and a second pressure chamber separated from the first pressure chamber by a diaphragm and wherein the fuel line upstream of said throttle device communicates with said first pressure chamber, a compression spring disposed in said second pressure chamber acting upon said diaphragm, said second pressure chamber communicating with the fuel line downstream of said throttle device and said throttle device being adjustable by means of the deflection of the diaphragm.

18. An apparatus in accordance with claim 17, including means for mechanically connecting said throttle device with said diaphragm.

19. An apparatus in accordance with claim 18, wherein said displacement-voltage converter includes an actuation rod to said diaphragm and a piston on said actuation rod and a spring for holding said piston on said actuation rod and a first stop and a second stop for supporting said spring.

20. An apparatus in accordance with claim 17, including a work piston having a front face for defining a work chamber and subjected to a return force, a relief line having an outflow aperture communicating with said second pressure chamber, said outflow aperture being controllable by means of said diaphragm, and said relief line upstream of said throttle communicating with said work chamber.

21. An apparatus in accordance with claim 20, including means for connecting said work piston with said throttle device.

22. An apparatus in accordance with claim 20, wherein said work piston comprises a throttle device, a cylinder having a cylindrical bore, said work piston disposed with said cylindrical bore and having an annular groove enclosed within said cylindrical bore, said annular groove geing disposed within the fuel supply line, and having one limitation edge, the wall of said cylinder having alongitudinal slit forming a first connection, cross-section for the fuel supply line controlled by said one limitation edge.

* * * * *